United States Patent [19]

Dickie et al.

[11] Patent Number: 5,072,868

[45] Date of Patent: Dec. 17, 1991

[54] PORTABLE WET PAINT BRUSH HOLDER

[75] Inventors: Robert G. Dickie, Ontario; Christopher A. Smith, Toronto, both of Canada

[73] Assignee: Brushmate Corporation, Toronto, Canada

[21] Appl. No.: 637,417

[22] Filed: Jan. 4, 1991

[51] Int. Cl.[5] ..... A45F 5/00

[52] U.S. Cl. ..... 224/252; 224/148; 224/904; 224/269; 224/200; 220/90

[58] Field of Search ..... 224/904, 240, 252, 253, 224/269, 242, 200; 220/90; 206/361; 24/562

[56] References Cited

U.S. PATENT DOCUMENTS

| | | | |
|---|---|---|---|
| 1,496,346 | 6/1924 | Lindmark | 220/90 |
| 1,761,630 | 6/1930 | Jentzen | 24/562 |
| 1,813,670 | 7/1931 | Kessler | 220/90 |
| 1,938,376 | 12/1933 | Dietrichs | 206/361 |
| 2,095,351 | 10/1937 | Van Winkle | 224/148 |
| 2,310,156 | 2/1943 | Van Der Clute | 24/562 |
| 2,661,858 | 12/1953 | Howell | 224/148 |
| 2,748,977 | 6/1956 | Sarchet | 220/90 |
| 3,384,277 | 5/1968 | Hodelka | 224/242 |
| 3,398,825 | 8/1968 | Flook, Jr. et al. | 206/361 |
| 3,535,709 | 10/1970 | Johannes | 224/148 |
| 3,611,351 | 5/1972 | Olsen | 248/311.2 |
| 4,014,453 | 3/1977 | Tarnacki | 220/90 |
| 4,561,556 | 12/1985 | Bendix | 220/90 |
| 4,746,042 | 5/1988 | Kind | 224/148 |
| 4,771,501 | 9/1988 | Leiter | 220/90 |
| 4,896,858 | 1/1990 | Sokolski | 248/311.2 |
| 4,951,857 | 8/1990 | Carr | 224/230 |

FOREIGN PATENT DOCUMENTS

| | | | |
|---|---|---|---|
| 788291 | 6/1968 | Canada | 220/90 |

*Primary Examiner*—Henry J. Recla
*Assistant Examiner*—Keith Kupferschmid
*Attorney, Agent, or Firm*—Robert O. Nimtz

[57] ABSTRACT

A portable wet paint brush holder which is formed by a substantially rectangular bottom panel, vertical front and rear walls, and substantially rectangular side walls forming an enclosure with a top opening for receiving the brush portion of a conventional paint brush having the handle extending in an upward direction. One of the side walls of the holder is substantially vertical, but the other is outwardly inclined from the vertical at the bottom by an acute angle of the order of thirty degrees so that the enclosure top opening is larger than the bottom portion. A flexible clip is attached to the rear wall adjacent to the angled side wall and the top of the rear wall for holding the paint brush handle and a flexible hinged gripper extends from the rear wall at the top for securing the holder to an external object such as the painter's belt or to a ladder strut or the lip of a paint can.

18 Claims, 3 Drawing Sheets

PORTABLE WET PAINT BRUSH HOLDER

TECHNICAL FIELD

This invention relates generally to portable paint brush holders and more particularly to portable holders which keep the handle of a wet paint brush above the paint and which may be readily clipped either to the painter's belt or to an external edge such as a ladder strut or the lip of a paint can with a high degree of security.

BACKGROUND OF THE INVENTION

The art is replete with paint brush holders which may be carried about by a painter as belt mounted holsters and which are designed to keep the handle of a brush dry and free of paint. Many tend, unfortunately, to be somewhat inconvenient for a painter to use and to require paint brushes to be specially modified before such brushes can be used with them. One example of such art is shown in U.S. Pat. No. 4,746,042, which issued May 24, 1988, to Richard C. King. That type of holder is formed by substantially vertical and rectangular front, back, and side panels, with an opening at the top and a substantially rectangular panel at the bottom, and can sometimes be difficult to use. In normal usage, a holder like the one shown in the King patent is worn at the painter's waist. Under such circumstances, when the painter attempts to insert a brush through the top opening, he will in all likelihood find that his hand at least partially obscures his view of the opening. The probable result will be that some bristles of the paint brush will catch on the edge of the holder and at least some paint will be flicked from those bristles. In addition, the type of brush holding arrangement shown in the King patent requires installation of special clips on the sides of all brushes before they can be used. As modified, the brush needs to be inserted with the clip oriented toward the outer lip at the top of the holder. Once again, the painter's hand is likely at least partially to obscure his view of the region in which the clip is to make contact with the edge of the holder.

SUMMARY OF THE INVENTION

The present invention overcomes many of the limitations of the prior art and makes a portable paint brush holder considerably easier to use. In its most general form, the invention is applicable to a portable holder for a wet paint brush in which the holder is formed by a substantially rectangular bottom panel, vertical opposing front and rear walls, and substantially rectangular opposing side walls forming an enclosure with a top opening for receiving the brush portion of a conventional paint brush having its handle extending in an upward direction. In accordance with a feature of the invention, one of the side walls is substantially vertical but the other is outwardly inclined from the vertical at the bottom by an acute angle of the order of thirty degrees, so that the top opening of the enclosure is somewhat larger than the bottom panel. When the paint brush holder is attached to the painter's belt, the inclined side wall faces to the painter's rear, permitting easier access to the brush, much in the manner of a hand gun holster. As will subsequently be described, a closely related feature of the invention is a flexible paint brush handle clip attached to the rear wall of the holder adjacent to the angled side wall and the top of the rear wall.

The first mentioned feature of the invention affords several important advantages. One of these is that, with such an arrangement, the bristles of the paint brush are no longer obscured from view by the painter's hand, allowing for easier insertion of the brush past the lip at the top of the holder. The thirty degree angle also is very close to the natural position of a brush held at the painter's waist. A second important advantage is that the diagonal entry formed by the angled side wall presents a larger target area for a paint brush handle when it is placed into the handle clip. Still another advantage is that removal of the paint brush is enhanced by the thirty degree angle of the side wall facing to the rear of the painter. The rearward tilted brush handle provides a natural (ergonomically correct) target for the painter's open hand to grasp when the hand is swept forward at the painter's waist. Removal of the brush is thus very similar to drawing a hand gun from an ordinary belt mounted holster. The painter's open hand sweeps forward to grasp the handle of the paint brush. Continuing forward and upward travel by the painter's hand tilts the brush and ends with the brush pointing forward at mid-chest height.

Another important feature of the invention is, as mentioned above, a flexible clip attached to the rear wall of the holder adjacent to the angled side wall and the top of the rear wall for holding the handle of a standard paint brush. In accordance with this feature of the invention, the flexible clip takes the form of two opposing jaws opening toward the substantially vertical side wall, with the space between the opposing jaws gradually increasing from the base of the clip toward the open end of the clip. The clip is of plastic material and has regularly spaced notches on the interior face of at least one of the two opposing jaws. Such a clip allows a wide range of brush sizes to be clipped into the portable brush holder and at any desired depth. If advantageous to do so, the brush may be suspended above the level of any paint which has either collected in the holder or has been deliberately added. Alternatively, the brush may be held with its bristles immersed in the paint but still clear of the bottom panel of the holder.

The tapered gripping jaws of the clip featured by the invention permit smaller bushes with smaller handles to be properly positioned against the rearward wall of the holder. As bushes get smaller, both the brush width and the handle thickness tend to remain proportional. It is advantageous for the bush always to remain against the real wall of the holder both for stability and for maintaining the approximately thirty degree positioning. A smaller brush engages further into the clip than a larger brush, allowing its narrower bristles to come into contact with the rear wall of the holder.

Still another feature of the invention is an arrangement which may be used either to attach the portable holder to the belt of a painter or to a stationary object such as a ladder strut or the curved lip of a paint can. In accordance with this feature, a flexible hinged gripper is attached to the top portion of the rear wall of the holder. The hinged gripper may be of plastic material, has bendable flaps at both ends next to rear wall of the holder with bottom cut-outs to permit gripping an external edge such as a ladder strut or the curved lip of a paint can, and has a substantially right angle bend on its side remote from the rear wall of the holder to permit gripping of the painter's belt. Both ends of the hinged gripper have terminal enlargements on the flaps at the cut-outs which permit the gripper, when flexed, to hold the portable paint brush holder securely to most ladder struts or lips of paint cans. When not in use, the gripper end flaps lie flat and do not interfere with clipping the portable holder to a painter's belt.

The invention and its several features will be better understood from the following more detailed description of a specific embodiment, taken in the light of the accompanying drawing and the appended claims.

BRIEF DESCRIPTION OF THE DRAWINGS

A complete understanding of the present invention may be gained by considering the following detailed description in conjunction with the accompanying drawings, in which.

To facilitate reader understanding, identical reference numerals are used to designate elements common to the figures.

DETAILED DESCRIPTION

Figure 1:
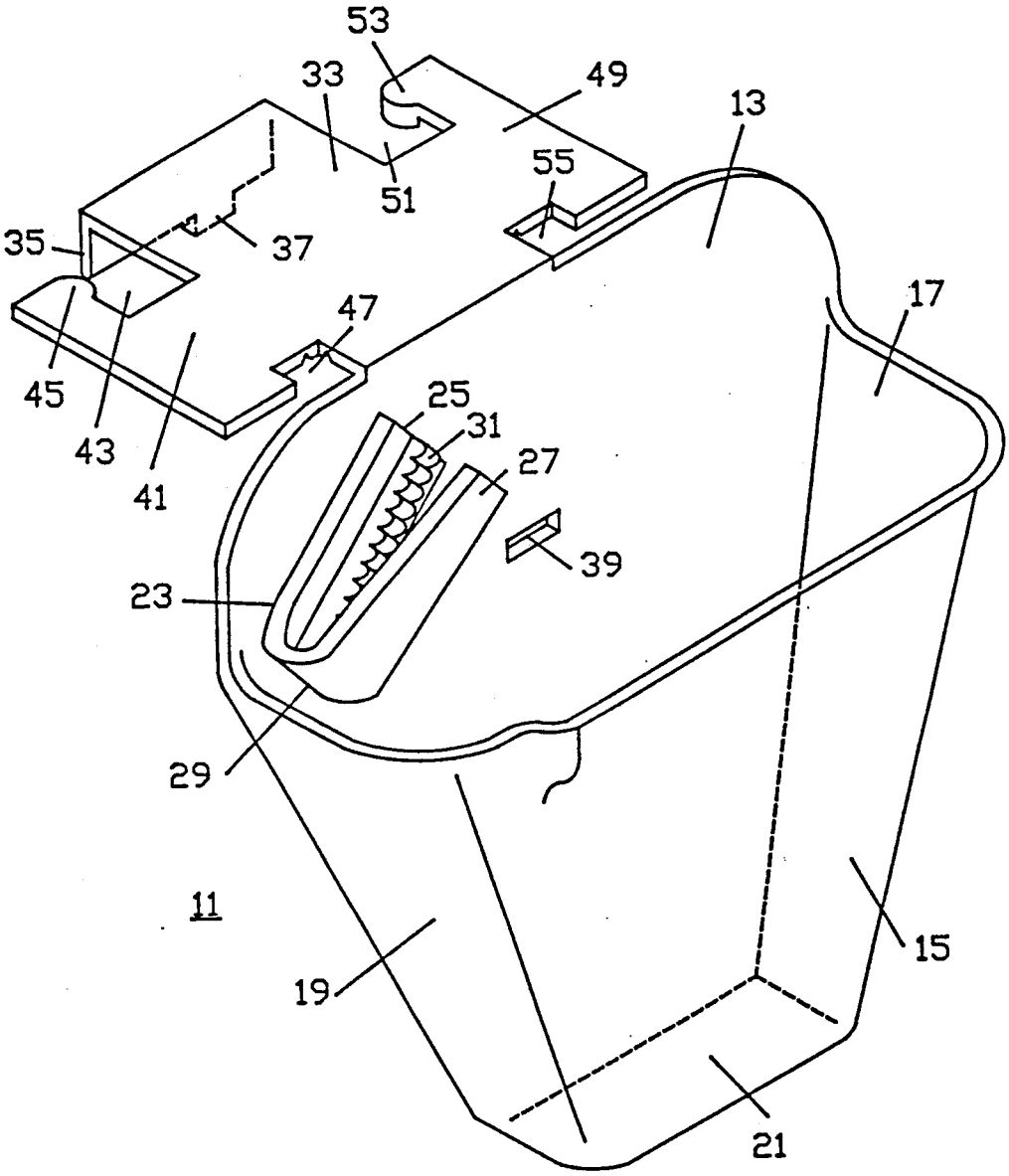
FIG. 1 is a perspective view of a complete portable paint brush holder embodying the several features of the invention.

It should also be clear to those skilled in the art that further embodiments of the present invention may be made by those skilled in the art without departing from the teachings of the present invention. Detailed Description FIG. 1 shows a portable paint brush holder 11 which is formed by a substantially vertical rear wall 13, a vertical front wall 15, a vertical side wall 17, a side wall 19, and a bottom panel 21. Portions of the boundaries of side wall 17 and bottom panel 21 are shown by dashed lines because they are obscured by the perspective. Side walls 17 and 19 are both substantially rectangular in shape, as is bottom panel 21. Side wall 19 is outwardly inclined from the vertical at the bottom, where it joins bottom panel 21, by an angle of substantially thirty degrees. The exact angle of inclination is not absolutely critical, but it generally should not depart from thirty degrees by more than about four or five degrees in either direction. As shown, rear wall 13 extends above front wall 15 and both side walls 17 and 19.

Paint brush holder 11 in FIG. 1 also includes a flexible clip 23 for holding the handle of a conventional paint brush (not shown). Clip 23 is made up by a pair of opposing jaws 25 and 27 which open toward the far top corner of rear wall 13, with the space between them gradually increasing with distance from the base 29 of clip 23. As shown, at least one of opposing jaws 25 and 27 has a row of regularly spaced notches 31 on its interior face. The back of clip jaw 25 is secured to the inner surface of rear wall 13 at the top corner of wall 13 which is in closest proximity to inclined side wall 19. Clip 23 is oriented on rear wall 13 so that jaws 25 and 27 extend at a substantially right angle from inclined side wall 19, as shown. To give it the appropriate amount of resiliency, clip 23 is preferably made of a plastic material such as polyproplyene, which may also be used for holder 11 itself.

The final portion of holder 11 which is of major significance is a hinged gripper 33 which extends rearward from the top of rear wall 13 and is intended to be bent down in use so that its plane becomes substantially parallel to that of rear wall 13. Gripper 33 is flexible and may be of the same plastic material as holder 11 and clip 23. Gripper 33 is mostly flat, as shown in FIG. 1, but has an edge member 35 on its extremity remote from and parallel to rear wall 13. Edge member 35 extends downward at an angle of substantially ninety degrees from the principal plane of gripper 33 (parallel to rear wall 13 when in the position shown in FIG. 1) and has a tab 37 which matches a hole 39 in the upper portion of rear wall 39. On one of its sides extending from rear wall 13, gripper 33 has a bendable end flap 41 with a cut-out 43 extending toward rear wall 13 from the far extremity of gripper 33 (the bottom when gripper 33 is bent downward to parallel rear wall 13). A slight enlargement or bump 45 is provided at the side of cut-out 43 to aid in gripping an external object. An additional cut-out 47 at the top of end flap 41 is provided to enable end flap 41 to be bent from the main plane of gripper 33 more easily. On the other of its sides extending from rear wall 13, gripper 33 has a bendable end flap 49 similar to flap 41, a cut-out 51 similar to cut-out 43, an enlargement or bump 53 similar to bump 45, and a cut-out 55 similar to cut-out 47. Gripper 33 is preferably of the same plastic material, such as polyproplyene, as clip 23 and holder 11 itself. Gripper 33 may be scored on its underside to permit easy bending downward to parallel rear wall 13 and to permit easy bending of end flaps 41 and 49.

Figures 2A, 2B, 2C:
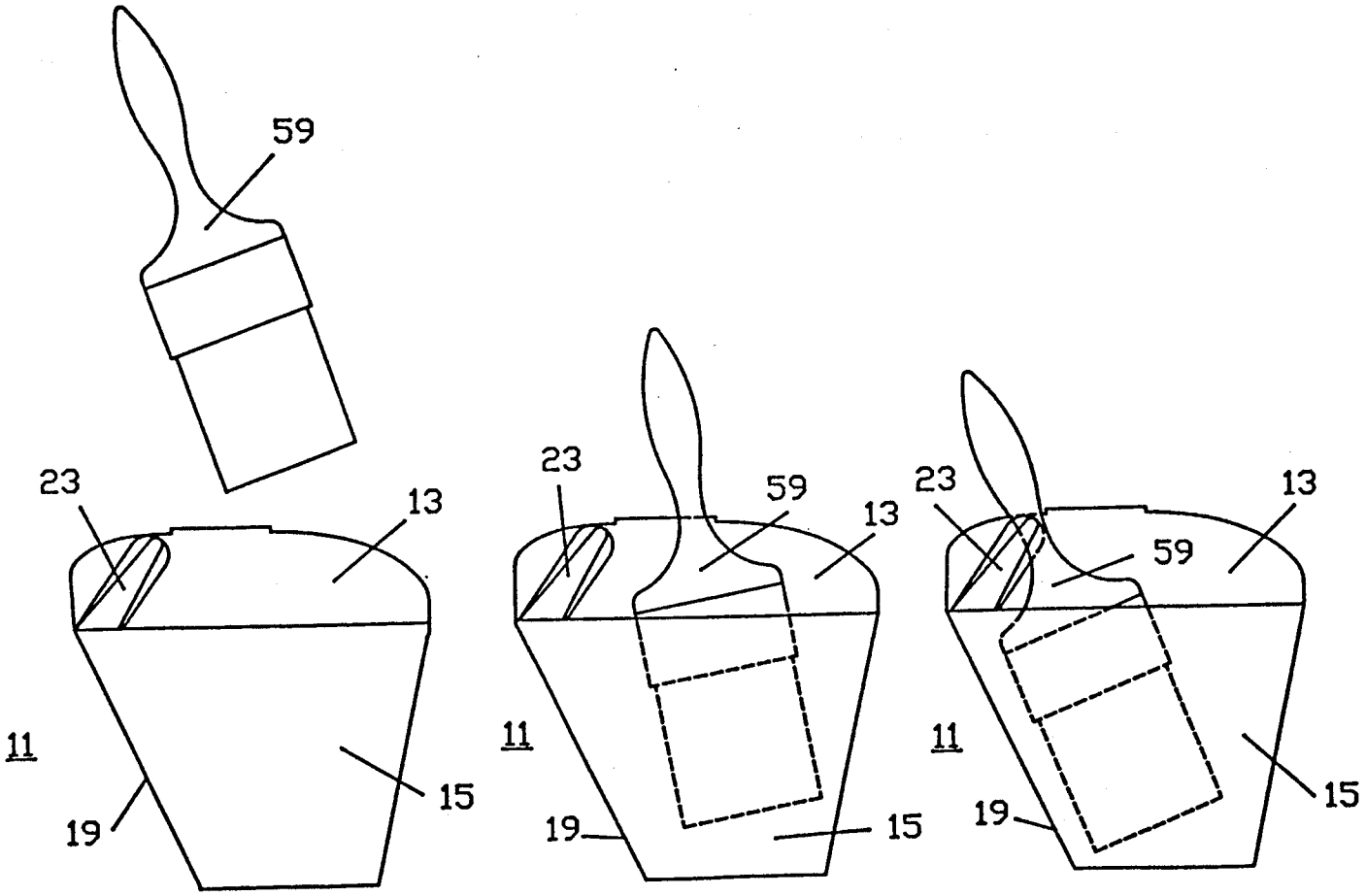
FIGS. 2A, 2B, and 2C are sequential front views of a portable paint brush holder embodying the invention, showing insertion of a standard paint brush into the holder until its handle is held by the flexible clip.

FIGS. 2A, 2B, and 2C are sequential views illustrating how a standard paint brush is inserted into the portable holder shown in FIG. 1. FIG. 2A is first in the sequence and shows a paint brush 59 above holder 11 prior to insertion. FIG. 2B is next and shows paint brush 59 partially inserted into holder 11. In FIG. 2B, the handle of brush 59 is not yet engaged by flexible clip 23. FIG. 2C is last in the sequence and shows paint brush 59 fully inserted into holder 11. The handle of brush 59 is engaged by the jaws of flexible clip 23 and the bristles of brush 59 are suspended just clear of the bottom of holder 11.

As can be seen from FIG. 2C, an additional advantage of the invention is neither a natural standing position nor a forward bending position on the part of a painter having holder 11 clipped to his belt significantly affects the position of the ends of the bristles of paint brush 59 with respect to the level of any paint in the bottom of holder 11. Paint brush 59 rests rearward and at an angle within holder 11. If the painter were to bend forward, the paint would move slightly to the front of the bottom of holder 11, maintaining the distance of the paint from the bristles. The reverse would be true if the painter were to bend backwards, but such action would be unlikely and would be physically difficult.

Figure 3:
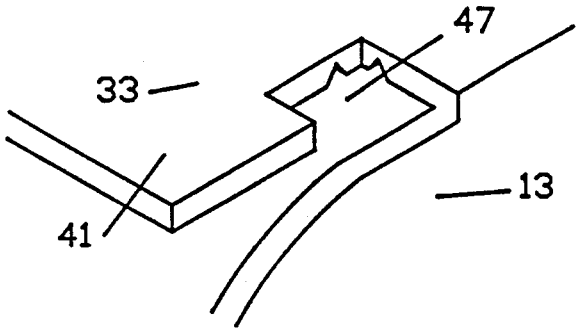
FIG. 3 is an enlarged view of a detail of the flexible gripper featured by the present invention.

FIG. 3 is an enlargement of a detail of flexible gripper 33 as shown in FIG. 1 and of the manner in which gripper 33 is attached to rear wall 13. FIG. 3 specifically shows end tab 41 and cut-out 47. Because gripper 33 is made of flexible plastic, it may easily be bent downward so that its plane substantially parallels the plane of rear wall 13 and bendable flap 41 may easily be bent upward from the plane of the remainder of gripper 33.

Figure 4:
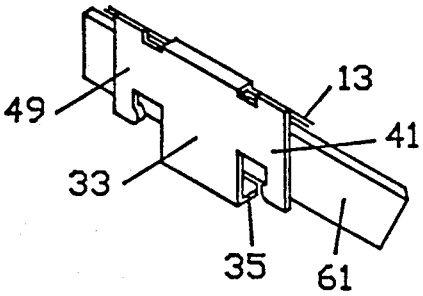
FIG. 4 shows how the flexible gripper may be attached securely to the painter's belt.

FIG. 4 illustrates the manner in which flexible gripper 33 may be adjusted to attach the paint brush holder securely to a belt 61 worn around the painter's waist. Gripper 33 has been folded over in FIG. 4 so that its plane parallels that of rear wall 13 but is on the inner side of belt 61. Paint brush holder 11 (shown in FIG. 1) remains on the outer side of belt 61. Tab 37 (shown in FIG. 1) has been snapped into hole 39 (shown in FIG. 1) of rear wall 13 and edge member 35 fits under belt 61. End flaps 41 and 49 remain flat and in line with the main plane of gripper 33.

Figure 5A:
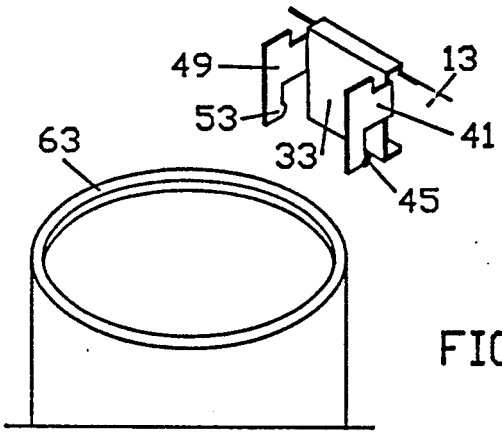
FIGS. 5A and 5B are sequential perspective views of the flexible gripper featured by the invention, showing preparation of the flexible gripper and its subsequent attachment to the lip of a standard paint can.
Figure 5B:
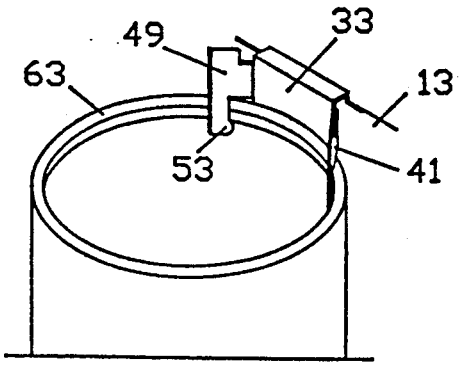

FIGS. 5A and 5B are sequential perspective views showing how flexible gripper 33 may be adjusted to hold the paint brush holder securely to an external edge such as the lip of a paint can 63. In FIG. 5A, end flaps 41 and 49 of gripper 33 have been folded outwardly away from the plane of rear wall 13. As shown, bumps 45 and 53 form gripping edges at the bottom-most portions of end flaps 41 and 49. In FIG. 5B, end flaps 41 and 49 have been slipped over the lip of paint can 63 and the paint brush holder is held securely in place. The flexible material of gripper 33, also preferably used in the construction of the paint brush holder itself, allows living hinge and spring actions which permit the jaws formed at the lower ends of end flaps 41 and 49 to flex out and hold securely to an edge. The relatively wide spacings between those jaws and bumps 45 and 53 serve to hold the paint brush holder securely to any lip up to about half an inch in width. As shown in FIGS. 5A and 5B, all the user needs to do is press back on end flaps 41 and 49, place gripper 33 over the lip of paint can 63, and release end flaps 41 and 49. As shown in FIG. 4, end flaps 41 and 49 remain flat when not in use and do not encumber usage with the painter's belt.

A further advantage to use of the same flexible plastic material used for clip 23 (in FIG. 1) and gripper 33 (in FIG. 1) in the construction of the paint brush holder 11 itself is that such material permits easy removal of dried paint simply by flexing the unit.

It is to be understood that the specific embodiment of the invention which has been described is illustrative. Numerous other arrangements and modifications may be readily devised by those skilled in the art without departing from the spirit and scope of the invention.

We claim:

1. A portable holder for a wet paint brush, said holder comprising a substantially rectangular bottom panel, vertical opposing front and rear walls, and substantially rectangular opposing side walls forming an enclosure with a top opening for receiving the brush portion of a conventional paint brush having its handle extending in an upward direction, characterized in that:

one of said side walls is substantially vertical and the other of said side walls is outwardly inclined from the vertical at the bottom by an acute angle so that said enclosure top opening is larger than said bottom portion and a flexible clip is mounted on said rear wall adjacent to the angled side wall and the top of said rear wall for holding the paint brush handle, the jaws of said clip extending at a substantially right angle with respect to the inclined one of said side walls.

2. A portable paint brush holder in accordance with claim 1 in which said flexible clip comprises two opposing jaws opening toward said substantially vertical sidewall, with the space between said opposing jaws gradually increasing from a closed end of said clip toward an open end of said clip.

3. A portable paint brush holder in accordance with claim 2 in which said acute angle is substantially thirty degrees.

4. A portable paint brush holder in accordance with claim 3 in which both said holder and said flexible clip are of the same plastic material and said flexible clip has regularly spaced notches on the interior face of at least one of said two opposing jaws.

5. A portable paint brush holder in accordance with claim 4 which includes means extending from said rear wall at the top for securely attaching said holder to an external object and maintaining said holder in a substantially upright position.

6. A portable paint brush holder in accordance with claim 5 in which said attaching means comprises a flexible hinged gripper extending from the top of said rear wall, said gripper being constructed at at least one of its exposed extremities to grip said external object securely.

7. A portable paint brush holder in accordance with claim 5 in which said hinged gripper has a substantially right angle bend on its extremity remote from said vertical sidewall to permit gripping a painter's belt securely.

8. A portable paint brush holder in accordance with claim 5 in which said hinged gripper has bottom cut-outs and bendable flaps at opposing ends of said gripper to permit gripping an external edge such as the lip of a paint can securely.

9. A portable paint brush holder in accordance with claim 5 in which said hinged gripper has both a substantially right angle bend on its extremity remote from said vertical sidewall to permit gripping a painter's belt securely and bottom cut-outs and bendable flaps at both of its ends to permit gripping an external edge such as the lip of a paint can securely.

10. A portable paint brush holder in accordance with claim 9 in which said hinged gripper is of the same plastic material as said holder and said flexible clip.

11. A portable paint brush holder in accordance with claim 3 in which said flexible clip is of plastic material and has regularly spaced notches on an interior face of at least one of said two opposing jaws.

12. A portable paint brush holder in accordance with claim 11 in which said flexible clip and said holder are both of the same plastic material.

13. A portable paint brush holder in accordance with claim 1 which includes means extending from said rear wall at the top for securely attaching said holder to an external object and maintaining said holder in a substantially vertical position.

14. A portable paint brush holder in accordance with claim 13 in which said attaching means comprises a flexible hinged gripper extending from the top of said rear wall, said gripper being constructed at at least one of its exposed extremities to grip an external object securely.

15. A portable paint brush holder in accordance with claim 14 in which said hinged gripper has a substantially right angle bend on its extremity remote from said vertical sidewall to permit gripping a painter's belt securely.

16. A portable paint brush holder in accordance with claim 14 in which said hinged gripper has bottom cut-outs and bendable flaps at opposing ends of said gripper to permit gripping an external edge such as the lip of a paint can securely.

17. A portable paint brush holder in accordance with claim 14 in which said hinged gripper has both a substantially right angle bend on its extremity remote from said vertical sidewall to permit gripping a painter's belt securely and bottom cut-outs and bendable flaps at both of its ends to permit gripping an external edge such as the lip of a paint can securely.

18. A portable paint brush holder in accordance with claim 17 in which said hinged gripper is of plastic material.

* * * * *